United States Patent [19]

Kuehnle

[11] 4,394,084

[45] Jul. 19, 1983

[54] LOW-PROFILE ELECTROPHOTOGRAPHIC COPYING MACHINE

[75] Inventor: Manfred R. Kuehnle, Lexington, Mass.

[73] Assignee: Coulter Systems Corporation, Bedford, Mass.

[21] Appl. No.: 281,305

[22] Filed: Jul. 8, 1981

Related U.S. Application Data

[63] Continuation of Ser. No. 11,309, Feb. 12, 1979, abandoned.

[51] Int. Cl.[3] ..... G03G 15/00

[52] U.S. Cl. ..... 355/3 BE; 355/11; 355/66

[58] Field of Search ..... 355/3 BE, 16, 11, 10, 355/66

[56] References Cited

U.S. PATENT DOCUMENTS

| | | | |
|---|---|---|---|
| 3,146,688 | 9/1964 | Clark et al. | 355/11 |
| 4,013,359 | 3/1977 | Dubois et al. | 355/16 |
| 4,077,710 | 3/1978 | Ward et al. | 355/11 X |

*Primary Examiner*—R. L. Moses

*Attorney, Agent, or Firm*—Silverman, Cass & Singer, Ltd.

[57] ABSTRACT

A low-profile electrophotographic copying machine employing an electrophotographic imaging system including an electrophotographic belt transportable through plural work stations at which the belt is charged, exposed to a projected image to establish a latent image, developed with suitable toner and optionally transferred to a carrier medium from a source thereof and fixed. The apparatus is housed so as to maximize conservation of space and to minimize the vertical dimension thereof. The belt has closely proximate reaches horizontally oriented and parallel except at the developing station. The apparatus uses a folded optical projection system whereby the image from a horizontally arranged document on a platen is projected by way of a pair of oppositely inclined mirrors through an intermediate lens system to the lower reach of the electrophotographic belt, which is positioned at about the same level as the platen. The developing station is disposed in the neck of the projection system between the expanded beams of the projection system.

31 Claims, 2 Drawing Figures

LOW-PROFILE ELECTROPHOTOGRAPHIC COPYING MACHINE

This is a Continuation, of application Ser. No. 11,309 filed Feb. 12, 1979 now abandoned.

BACKGROUND OF THE INVENTION

This invention relates generally to electrophotographic copying machines and more particularly, provides an electrophotographic copying machine especially for table top use which is characterized when assembled in a housing by a compact, low-profile assembly having a much reduced vertical dimension with maximum interior space utilization.

Electrophotographic copying machines include an electrophotographic member which is transported through plural work stations sequentially at which a charge potential is applied to the member, the charged member is exposed to a projected light image to form a latent electrophotographic image thereof, toner is applied to said latent image and said toned latent image is transferred to a carrier. The latent image carrier is discharged with or without fixing of the developed image as by fusing or the like.

The electrophotographic member may be in the form of an endless belt carrying a chargeable photoconductive coating and mounted on at least a pair of spaced rollers to define a pair of reaches, preferably parallel closely proximate reaches. The charging station, the exposing station and the toning station are positioned along one of said reaches, said one reach preferably being located in a plane at or immediately adjacent to the focal plane of the projection system used. Also optional, but often provided, is an additional work station whereat the excess toner is removed from the belt prior to initiation of a new cycle once the imaging cycle has been completed.

Machines of the general type described are known to be large and bulky. As presently available, the various work stations each require considerable space which mandates the large housings. Such bulk is not well suited to table top usage. Provision for compact arrangement of these stations heretofore has not been made in view of the present construction of the various elements of these stations without regard for maximum space utilization. Heretofore, provision of table top copier designs have employed miniaturization of elements which materially reduces the versatility and utility of the machine. Further, considerable difficulties have been experienced arising out of such miniaturization in respect of servicing of the machines. Service and assembly of such machines require particularly skilled servicemen and on site tear-down, also with considerable downtime for the user of the machine.

It would be most desirable to provide a compact, low-profile structure for use as an electrophotographic copying machine wherein the reduction in bulk is accomplished through maximum utilization of space, minimization of vertical dimension and without the necessity for miniaturization of the functional elements thereof.

SUMMARY OF THE INVENTION

A low-profile electrophotographic copying machine especially for table-top use which comprises: a housing, electrophotographic imaging means mounted within said housing and including an electrophotographic belt mounted for rotational and horizontal movement on at least a pair of spaced rollers to define a pair of generally parallel closely proximate reaches, drive means operable upon said rollers, a horizontally oriented copy platen horizontally offset from and generally at the same level as the belt, a charging station, an exposing station and a developing station, all arranged along the path of one of said reaches sequentially spaced, a folded optical projection system for applying an image from said copy platen to said one belt reach at the exposure station, means for mounting said optical projection system within said housing below said belt and said platen, said toning station including a toner cartridge mounted on said last mentioned mounting means and between the expanded beams of said projection system, one of said rollers being larger than the other and disposed in close proximity to said toner cartridge, said one roller and cartridge together comprising said toning station. A carrier medium supply and feed is disposed proximate the upper reach of said belt and a transfer station is provided to receive said carrier medium and to effect transfer of the image from the belt to the carrier for delivery from the machine.

DESCRIPTION OF THE PREFERRED EMBODIMENT

Figure 1:
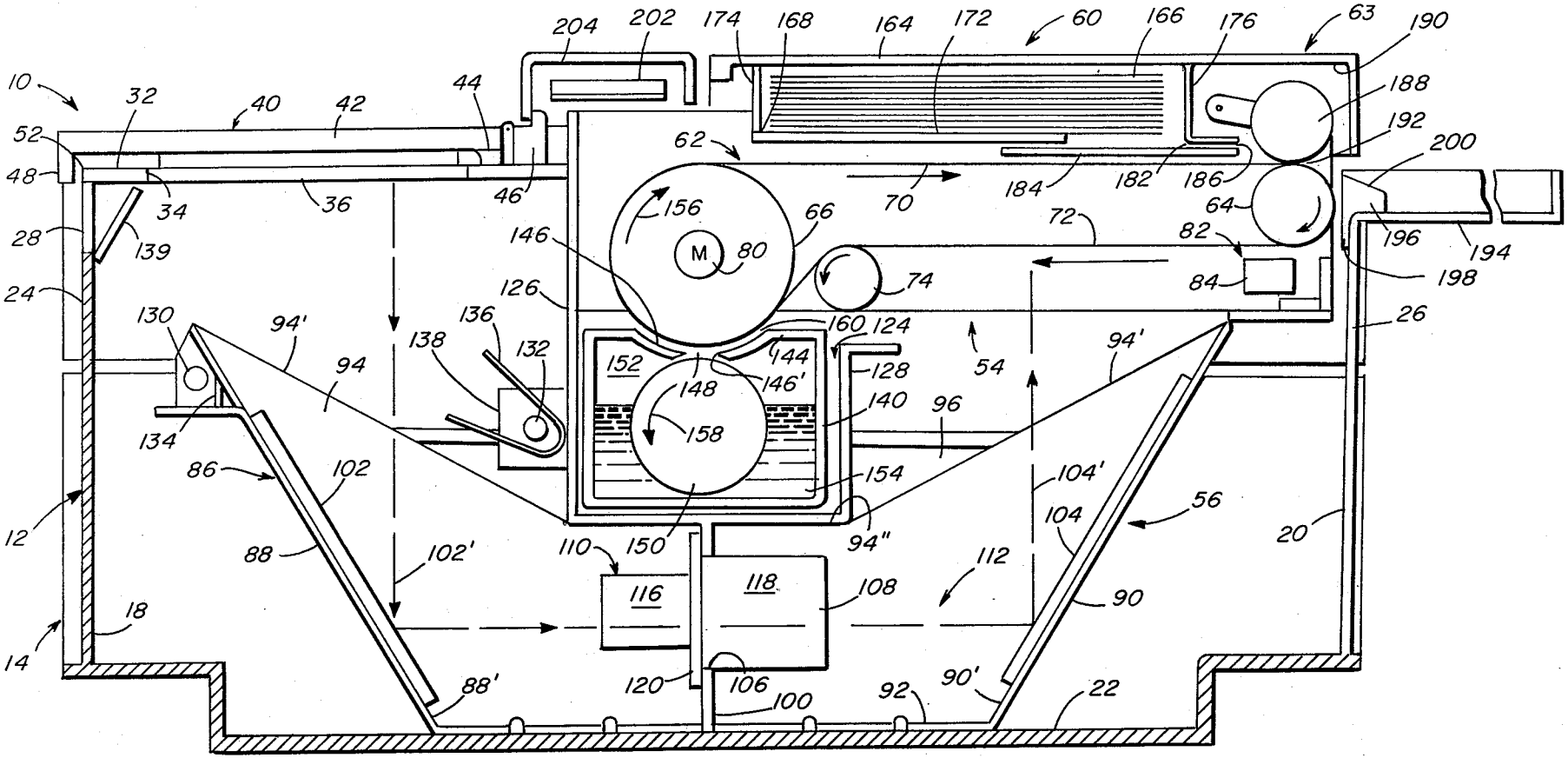
FIG. 1 is a diagrammatic sectional elevational representation of the low-profile electrophotographic copying machine especially for table top use constructed in accordance with the invention herein.
Figure 2:
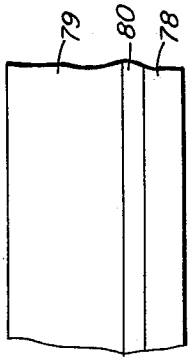
FIG. 2 is an enlarged cross-section taken along lines 2—2 of FIG. 1.

Referring to the drawing, the low-profile electrophotographic copying machine constructed in accordance with the invention is designated generally by reference numeral 10 with the functional elements comprising the work stations thereof housed within a light tight housing 12. Housing 12 is formed of a box-like hollow section 14 and a cover section 16 adapted to be seated upon the section 14. Housing section 14 includes a pair of end walls 18 and 20 secured to a bottom wall or floor 22, end walls 18 and 20 having vertical extensions 24 and 26 respectively.

Cover 16 includes a pair of end walls 28 and 30 and a top wall 32. Top wall 32 has an opening 34 near the wall 28 and means are provided about the edges of opening 34 to mount a transparent copy platen 16 preferably flush with the wall 32. The platen may be formed of glass or plastic so long as it is transparent.

A platen cover assembly 40 includes a platen cover 42 connected along one edge via hinge 44 to flat U-shaped member 46. The free edge of cover 42 has a depending flange 48, which flange engages corner 52 of housing cover 16 securely so as firmly to position a document between the platen 36 and the platen cover 42.

The electrophotographic imaging system, generally designated by reference numeral 54, is mounted within the housing 12. An optical projection system designated generally by reference numeral 56 also is mounted within the housing 12 and below the copy platen and the electrophotographic imaging system. A developing station designated generally by reference numeral 58 is located between the systems 54 and 56 while a carrier supply and feed system 60 is seated above the electrophotographic imaging system 54 and a transfer station 62 is located adjacent the system 60.

The electrophotographic imaging system 54 includes an endless electrophotographic belt 62 mounted on a pair of spaced rollers 64,66 for clockwise movement in the direction of arrows 68 and defining closely proximate upper and lower reaches 70 and 72. A guide or aligning roller 74 is positioned beneath the reach 72 of belt 62 near the roller 66. The belt 62 preferably comprises a conductive substrate 80 on which is bonded a photoconductive coating 78 comprising r.f. sputtered wholly inorganic, microcrystalline electrically anisotropic photoconductive material having a thickness from about 0.2 microns to about 2 microns. One useful coating 78 employed herein is described in U.S. Pat. No. 4,025,339 of May 24, 1978. The conductive substrate may comprise a layer 80 of indium-tin oxide sputter coated upon a sheet 79 of stable insulating material, e.g., a polyester such as polyethyene terphalate. A flexible metal sleeve (not shown) upon which the described photoconductive coating has been applied could be used as well. The coating 78 is capable of being charged and of holding such applied charge sufficient to be toned subsequent to selective discharge upon projection of a light image upon the charged coating 78 to provide a latent electrostatic image.

As used throughout the specification and claims, the term electrophotographic belt 62 is intended to mean an endless belt carrying at least a portion of which carries a coating or layer of a photoconductive material which can be used electrophotographically. The electrophotographic coating 78 can be charged and exposed at high speed with the resultant electrostatic latent image capable of being transferred to another carrier medium, preferably paper. The electrostatic latent image can be toned with liquid toner or the like before or after transfer to the carrier medium and after toning can be permanently fixed on said carrier, as by fusing, etc.

As mounted on rollers 64 and 66, the photoconductive coating 78 faces outward with the lower reach 72 facing downward. The electrophotographic belt 62 is located offset from the copy platen 36 but generally on the same level with the reaches 70 and 72, at least the lower reach 72 thereof being oriented in a plane in or adjacent to the focal plane of the copy platen 36. One roller 66 of the rollers 64,66 is coupled to a drive motor 80 for driving the belt 68. Roller 66 has a diameter substantially greater than that of roller 64 and functions not only to drive the belt 62 but to cooperate with means at the toning station 58 to be described. Roller 66 may be hollow to contain the motor 80.

The charging station represented by reference character 82 is located adjacent the right hand end of the belt 62 proximate the roller 58 and below the same. The charging station 82 includes a corona generating device 84 operating to apply a uniform charge potential upon the belt 62 as the same is driven therepast.

The optical projection system 56 preferably is a self-contained unit comprising a rigid molded basket-like support member 86 having a pair of opposite walls 88 and 90 inclined preferably at an angle of 45° relative a floor 92, and a pair of connecting walls 94 and 96. Walls 94,96 also may be canted outwardly respectively and include inclined edges and horizontally oriented edges such as represented by reference numerals 94', 94'' respectively. A pair of planar mirrors 102, 104 are secured, as by adhesive, to the inner surfaces 88' and 90' of walls 88 and 90. A passageway 106 is formed in the partition 100 and a lens system 108 housed in cylindrical cannister 110 is seated frictionally therein. The mirror 102 is located below the copy platen 36 while the mirror 104 is located below the planar horizontal reach 72 of belt 62. Suitable cooperative coupling means are provided in the floor of the housing section 14 and in the floor 92 of the basket-like support 86 so that said support 86 with its mirrors 102,104 and lens system 108 can be secured removably in the housing section 14 correctly oriented to project a light image of the document to be copied from the copy platen 36 upon which said document is placed face down, to the horizontal reach 72 of the electrophotographic belt 62 subsequent to application of uniform charge potential to the surface of coating 78 carried thereby. The optical projection system 56 can be described as a "folded" projection system because of the manner of placement of the mirrors 102,104 and lens system 106 with the expanded beams 102',104' defining a neck 112. The lens 108 is enclosed in a canister 110 formed of a pair of different diameter portions 116 and 118 conjoined at annular flange 120. The diameter of opening or aperture 106 formed in partition 100 is only slightly larger than the diameter of canister 118 so as to receive said portion 118 is frictional engagement with the flange 120 seated against the partition 100.

A channeled well 124 having opposite walls 126 and 128 is seated on the horizontal edges 94'' across the support member 86 and rests on the upper edge of partition 100. Suitable lamps 130 and 132 with associated reflectors 134 and 136 are secured respectively to the end wall 88 and to the wall 126 of the wall 124. The mounting bracket 138 is formed preferably as a part of the integral molded basket-like member 86. Planar reflector 139 is positioned adjacent the inner left hand side corner of the housing cover 16 and is directed properly to reflect the light from lamp 130 for illuminating the document D while the area of the belt reach 72 which receives the projected image can be described as constituting the exposure station of the electrophotographic imaging system 54. Here the coating 78 carrying the uniform charge potential which has been applied thereto by corona generating device 84 selectively is discharged to form a latent electrostatic image of the document D.

The developing station 58 comprises a toner cartridge 140 seated within the channeled well 124. Housing sections 12 and 16 have matched, notched areas adapted to be disposed at the location of the well 124 when opposite sections 14 and 16 are assembled to define an entrance thereat to receive the toner cartridge 140. Toner cartridge 140 is generally rectangular in configuration and includes top wall 144 formed with an elongate arcuate wall portion 146 carrying a slot 148 running longitudinally of cartridge 140 almost the full length thereof and being parallel to the longitudinal edges of portion 146. Slot 148 located midway between the edges 146 and spaced inward of the end walls thereof. The arcuate wall portion 146 may be formed of metal or other conductive material whereby to enable its function as a development electrode. The remaining portions of the cartridge 140 are formed of electrically insulating material. Feed roller 150 is disposed within the interior compartment 152 of cartridge 140 in which liquid toner 154 has been introduced. Roller 150 is mechanically coupled by suitable means (not shown) to the roller 66 and rotates upon rotation of the roller 66 but in the opposite direction therefrom, see arrows 156 and 158. Feed roller 150 does not contact roller 66 and does not contact the blade edges 146' of arcuate portion 146 bordering slot 148. Instead, roller 150 is spaced from the roller 66 and the belt 62 driven thereby, a distance amounting to a few thousandths of an inch to define with said roller and belt a gap 160. Toner particles from the liquid toner 154 are deposited upon the belt 62 carrying the electrostatic latent image as the belt 62 passes through gap 160 by means of capillary action and is biased toward the belt 62 by the effect of the development electrode constituted by the metal clad arcuate portion 146. Accordingly, the electrostatic latent image is toned or developed and carried with the belt 62 around roller 66 to the upper reach 70 of the belt 62.

The carrier supply and feed system 60 is mounted as a unit above the electrophotographic imaging system 54 and comprises a compartment 162 attached to cover 16 and including a pivotally mounted across cover 164. The feed mechanism (not shown) is of the conventional bottom-feed type. Preferably, the carrier medium comprises paper sheets 166 stored in tray 168. Tray 168 includes side walls, such as represented by reference numeral 170, bottom wall 172, rear wall 174 and a front wall 176. Horizontal flange 180 is secured to, or is integral with, the lower end 182 of front wall 176 establishing a substantially right angle thereto. Bridge portion 184 is secured to the under surface of the bottom wall 172 and extends outward of and parallel to said bottom wall 172 to define with the flange 180, a delivery chute 186. The paper sheets 166 from the supply 60 are delivered sheet by sheet to and through the chute 186 into the transfer station 62.

Transfer station 63 comprises a pivotally mounted and electrically charged transfer roller 188 journalled within compartment 190 defined above the flange 180. Transfer roller 188 functions to move each sheet 166 of paper received from delivery chute 186 and assists in transferring the developed image from the belt 62 when belt 62 and sheet 166 travel through gap 192 defined between roller 188 and roller 64. Suitable electrical connections and circuitry may be used to provide the electrical bias for aiding the toning and transfer functions.

Delivery tray 194 is provided to receive the sheets 166 of paper carrying the transferred image from the gap 192. Delivery tray 194 is of open-topped, box-like configuration, including a thickened wall portion 196 which includes a depending overhang 198 and a canted or upper sloped surface 200. Canted surface 200 functions to guide the sheets 166 from the gap 186 to the delivery tray 194. The overhang 198 is used removably to couple the delivery tray 194 to the housing 12 of the machine 10, clamping onto end wall 20 thereof.

As viewed in the drawing, the control panel 202 is enclosed within housing 204 seated between the platen cover assembly 40 and the paper supply and feed 60 with the top wall 206 of the control housing 202 co-planar with the access cover 164 of the paper supply 60. All the electronic controls, circuitry boards (not shown) are contained therein.

As is evidenced in the drawing, one can observe that the use of enlarged diameter roller 66 seated within a recessed portion 146 of the toner cartridge 140, and positioning of the smaller diameter roller 64 enables the reaches of the belt to be placed very close one to the other. The location of the development station 58 between the expanded beams 102', 104' of the optical projection system 56 offers a substantial saving of interior space. The disposition of the toner cartridge well 124 within the neck 112 and just above the lens system 108 and the and the use of the folded optical projection system 56 also permits of maximum utilization of space and the resulting material reduction in the overall vertical dimension of the machine 10, i.e., low profile. Such result described is accomplished without miniaturization or sacrifice of utility; loss of versatility or resolution over the larger, bulkier conventional structures.

Minor variations in structure may be effected without departing from the spirit and scope of the invention as defined in the appended claims.

What I claim is:

1. A low-profile electrophotographic copying machine especially suitable for table top use comprising an electrophotographic imaging belt mounted for rotational and horizontal movement on at least a pair of spaced rollers, to define a pair of substantially parallel horizontally oriented closely proximate upper and lower reaches, the lower reach of which is positioned to define an image plane, at least one of said rollers being driven, drive means for driving the said roller and producing rotational movement of said belt, a charging station, including a corona generating device arranged adjacent the path of said belt for applying a charge potential thereto as the belt travels therepast and an exposure station located along the path of said belt downstream of said charging station whereat a light image is projected onto said charged belt to form an electrostatic latent image, a horizontal copy platen arranged substantially parallel with and spaced from said electrophotographic belt generally at about the same level as said upper reach of said electrophotographic belt, a folded optical projection station including a projection system for projecting light image of a document from the copy platen to said electrophotographic belt at said exposure station to form said electrostatic latent image on said lower reach of said belt at the image plane, a development station located along the path of said belt downstream of said exposure station for developing said electrostatic latent image as the electrophotographic belt travels therepast, a carrier medium supply and feed station, mounted above said electrophotographic belt whereby to dispense carrier medium to said belt subsequent to development of said electrostatic latent image on the belt, and an image transfer station, including means for transferring said developed image onto said carrier medium after receipt of the carrier medium from said supply and feed station and delivering said carrier medium having said transferred image to the exterior of said machine, the upper reach of the electrophotographic belt being positioned proximate both said last mentioned two stations to provide for delivery of the carrier medium to said upper reach and the reception of said carrier medium by said upper reach, a housing for containing said electrophotographic imaging belt, said folded optical station, said developing station and said carrier supply station, said developing station being partially nested within said folded projection station, with said electrophotographic belt being located between and closely proximate to said developing station and said carrier medium supply station.

2. The copying machine as claimed in claim 1 in which said electrophotographic belt includes a conductive substrate and a photoconductive coating carried on said substrate upon the outwardly facing surface thereof.

3. The copying machine as claimed in claim 2 in which said photoconductive coating comprises an r.f. sputtered, microcrystalline, wholly inorganic, electrically anisotropic photoconductive material having the capability of being electrically charged and rapidly discharged, as well as the capability of holding said charge at a magnitude sufficient to be toned.

4. The copying machine as claimed in claim 1 in which said housing includes an upper portion, a lower portion and a pair of side portions defining a pair of opposite upper corner portions, said copy platen located adjacent one upper corner portion and the carrier medium supply station being located adjacent the opposite upper corner portion, said optical projection system including a rigid basket-like support member having a pair of equally inclined but oppositely facing walls and a pair of mirrors secured to said inclined walls, each mirror being secured to a respective facing inclined wall surface, and said basket-like support member including an upstanding apertured partition and a lens system seated within said apertured partition in alignment with said mirrors for projecting an image from the copy platen to said electrophotographic belt, said development station being located seated upon said partition within the upper portion of said basket-like support member, and said electrophotographic belt located between said development station and said carrier supply station, said development station including a toner cartridge in close proximity of said one end of said electrophotographic belt and said charging station is disposed adjacent the opposite end of said electrophotographic belt.

5. The copying machine as claimed in claim 4 and sealing means on said partition to receive said cartridge in toning proximity to said electrophotographic belt and said cartridge including an elongate arcuate portion carrying a longitudinal slot along the length thereof and a roller applicator disposed within said cartridge, said arcuate portion including a conductive surface facing said photoconductive surface of said belt.

6. The copying machine as claimed in claim 5 in which the roller which is proximate said toner cartridge is of greater diameter than the other roller, and the outer circumference thereof being in close proximity to said arcuate portion of said toner cartridge to define a gap therebetween.

7. The copying machine as claimed in claim 6 in which there are means to generate an electrical bias across said gap.

8. A low-profile electrophotographic copying machine comprising:

an electrophotographic imaging belt; a charging station an exposure station; and a development station; a carrier medium supply and feed station; a folded optical projection station having a pair of spaced beams for directing a light image from a document to said electrophotographic belt; and a transfer station for applying the developed image to a carrier medium which is received from said supply thereof, spaced roller means for mounting and driving said electrophotographic belt and forming thereby a pair of closely proximate, horizontally oriented reaches of said belt, the lower reach defining said exposure station between its ends, said development station being disposed nested between said spaced beams and within said optical projection system, a copy platen for holding said document oriented to face said optical projection system with the upper reach of said electrophotographic belt spaced laterally from said copy platen and at generally about the same level thereof, said carrier medium supply and feed station being disposed above said electrophotographic imaging station likewise at about the same level as said copy platen and a housing for containing said electrophotographic imaging belt, said folded optical projection station, said developing station and said developing station being mounted partially nested within said folded optical projection station with said electrophotographic imaging station being located between and closely proximate to both said developing station and said carrier medium supply station.

9. The copying machine as claimed in claim 8 in which said drive means include a drive roller and a follower roller, the drive roller being of larger diameter than the follower roller and disposed nested within said development station as a part thereof.

10. The copying machine as claimed in claim 8 in which the copy platen being disposed generally parallel with said electrophotographic belt.

11. The copying machine as claimed in claim 8 in which said optical projection system includes a rigid support member of basket-like configuration having a pair of oppositely outwardly inclined end walls, a floor and connecting walls and an upstanding partition integral with said floor and disposed between said end walls, a pair of planar mirrors disposed in facing relationship upon respective ones of said end walls and a lens arrangement secured to said partition whereby to project said document image from said copy platen to the downwardly facing photoconductive coating carried on the outwardly facing surface of said belt.

12. The copy machine as claimed in claim 9 in which said toner station includes a liquid toner containing cartridge formed of electrically insulating material and including a top wall and a longitudinally directed arcuate recessed formation formed on said top wall, an elongate slot formed at the base of said recessed formation, and a conductive surface surrounding said slot along its length along its length, said larger roler being disposed sufficiently within said recessed formation to define a gap between the belt driven thereby and said recessed formation means to place an electrical bias voltage across said gap, said liquid toner being directed to said gap due to capillarity therebetween and the toner particles of said liquid toner being impelled toward said belt by said electrical bias.

13. The copy machine as claimed in claim 12 in which there are means to establish an electrical bias to effect transfer of said developed image from said belt to said carrier medium when said carrier medium is directed therepast.

14. The copy machine as claimed in claim 12 in which said transfer station includes a transfer roller proximate said belt at the upper reach thereof to define a second gap located therebetween and means to establish an electrical bias across said second gap during passage of said carrier medium therethrough.

15. A low-profile electrophotographic copying machine especially suitable for table top use comprising an electrophotographic imaging belt having an outwardly facing photoconductive coating and mounted for rotation in a parallel horizontal movement on at least a pair of spaced rollers, at least one of said rollers being driven and drive means for said one roller, the belt being formed in a general elongate oval and having upper and lower reaches, a charging station, including a corona generating device arranged adjacent the path of said belt for applying a charge potential thereto as the belt travels therepast and an exposure station located along said lower reach downstream of said charging station whereat a light image is projected onto said charged belt to form an electrostatic latent image on said lower reach, a horizontal copy platen arranged substantially parallel with and spaced laterally from said electrophotographic belt, a folded optical projection station including a projection system for projecting a light image of a document from the copy platen to said electrophotographic belt at said exposure station to form said electrostatic latent image on the lower reach of said belt, a development station located along the path of said belt downstream of said exposure station for developing said electrostatic latent image as the electrophotographic belt travels therepast, a carrier medium supply and feed station mounted above the upper reach of said electrophotographic belt whereby to dispense carrier medium to said belt subsequent to development of said electrostatic latent image thereon, an image transfer station, including means for transferring said developed image onto said carrier medium after receipt of said carrier medium from said supply and feed station and propelling said carrier medium having said transferred image toward the exterior of said machine and a housing including an upper portion, a lower portion and a pair of side portions defining a pair of opposite upper corner portions, said copy platen being located adjacent one upper corner portion and the carrier medium supply station being located adjacent the opposite upper corner portion, said optical projection system including a rigid basket-like support member having a pair of equally inclined but oppositely facing walls and a pair of mirrors secured to said inclined walls, each mirror being secured to a respective facing inclined wall surface, and said basket-like support member including an upstanding apertured partition and a lens system seated within said apertured partition in alignment with said mirrors for projecting an image from the copy platen to said electrophotographic belt onto the lower reach thereof, said development station being seated upon said partition within upper portion of said basket-like support member, and said electrophotographic belt being located between said development station and said carrier supply station, said development station including a toner cartridge in close proximity of one end of said lower reach of said electrophotographic belt and said charging station being disposed adjacent the opposite end of said lower reach of said electrophotographic belt, means seated on said partition for supporting said cartridge at said development station-, said cartridge having an open top along its length and a roller applicator disposed within said cartridge, and a conductive surface facing said photoconductive surface of said belt and defining a toning gap therebetween.

16. The copying machine as claimed in claim 15 in which there are means to generate an electrical bias across said gap.

17. A low-profile electrophotographic copying machine especially suitable for table top use and comprising:

an electrophotographic belt having an exterior photoconductive coating; a charging station; an exposure station; a development station; a carrier medium supply and feed station; a folded optical projection station having a pair of spaced mirrors for directing a light image from a document to said electrophotographic belt; a transfer station for applying the developed image to a carrier medium which is received from said supply thereof;

means for mounting and driving said electrophotographic belt in an oval path and defining a pair of closely proximate, horizontally oriented belt reaches, the lower reach defining said exposure station between its ends, said development station disposed nested between said spaced mirrors and within said optical projection system, a copy platen for holding said document oriented to face said optical projection system, said reaches of said electrophotographic belt being spaced laterally from said copy platen and the upper reach thereof being generally at about the same level as said copy platen, said drive means for rotating said electrophotographic belt including a drive roller for guiding said belt through the developing station, said carrier medium supply and feed station disposed immediately above said upper reach of said electrophotographic belt likewise at about the same level as said copy platen.

18. The copying machine as claimed in claim 17 in which the copy platen is disposed parallel with and horizontally spaced from said electrophotographic belt.

19. The copying machine as claimed in claim 17 in which said optical projection system includes a rigid support member of basket-like configuration having a pair of oppositely outwardly inclined end walls, a floor and connecting walls and an upstanding partition integral with said floor and disposed between said end walls, the pair of planar mirrors disposed in facing relationship upon respective ones of said end walls and a lens arrangement secured to said partition whereby to project said document image from said copy platen to the lower reach of said belt.

20. The copy machine as claimed in claim 17 in which said toner station includes a liquid toner containing cartridge formed of electrically insulating material and including a top wall and a longitudinally directed arcuate recessed formation formed on said top wall, an elongate slot formed at the base of said recessed formation, and a conductive surface surrounding said slot along its length, said drive roller being disposed sufficiently within said recessed formation to define a gap between the belt driven thereby and said recessed formation means to place an electrical bias voltage across said gap, said liquid toner being directed to said gap due to capillarity and the toner particles of said liquid toner being impelled toward said belt by said electrical bias.

21. The copy machine as claimed in claim 17 in which there are means to establish an electrical bias to effect transfer of said developed image from said belt to said carrier medium.

22. The copy machine as claimed in claim 17 in which said transfer station includes a transfer roller proximate said belt at the upper reach thereof to define a second gap and means to establish an electrical bias across said second gap during passage of said carrier medium through said gap.

23. A low-profile electrophotographic copying machine especially suitable for table top use comprising:

an endless electrophotographic belt having an outwardly facing photoconductive surface and mounted for rotation in a parallel horizontal movement on at least a pair of spaced rollers and forming a generally elongate oval having a pair of substantially parallel horizontally oriented closely proximate upper and lower belt reaches, the lower belt reach being positioned to define an image plane, at least one of said rollers being driven and drive means for driving the said one roller, a charging station, including a corona generating device arranged adjacent the path of said belt for applying a charge potential to the belt and an exposure station located along said lower reach downstream of said charging station whereat a light image is projected onto said charged belt at the image plane to form an electrostatic latent image on said lower reach;

a horizontal copy platen arranged substantially parallel with and spaced laterally from said electrophotographic belt generally at about the same level as said upper reach of said electrophotographic belt, a folded optical projection station including a projection system for projecting a light image of a document from the copy platen to said electrophotographic belt at said exposure station to form said electrostatic latent image on the lower reach of said belt at the image plane, a development station located along the path of the lower reach of said belt downstream of said exposure station for developing said electrostatic latent image as the electrophotographic belt travels therepast, a carrier medium supply and feed station, mounted above the upper reach of said electrophotographic belt whereby to dispense carrier medium to said belt subsequent to development of said electrostatic latent image on the belt, an image transfer station including means for transferring said developed image onto said carrier medium after receipt of said carrier medium from said supply and feed station and propelling said carrier medium having said transferred image toward the exterior of said machine, the upper reach of the electrophotographic belt being positioned proximate both said last mentioned two stations, a housing for containing said electrophotographic imaging system, said folded optical projection station, said developing station and said supply and feed station, said developing station being mounted partially nested within said folded optical projection station, said electrophotographic belt and spaced rollers being located between said developing station and said supply and feed station in close proximity thereto, said housing including an upper portion, a lower portion and a pair of side portions defining a pair of opposite upper corner portions, said copy platen being located adjacent one upper corner portion and the supply and feed station being located adjacent the opposite upper corner portion;

said optical projection system including a rigid basket-like support member having a pair of equally inclined but oppositely facing walls and mirror means secured to a respective facing inclined wall surface, said basket-like support member including an upstanding apertured partition and a lens system seated fixedly within said apertured partition in alignment with said mirrors for projecting an image from the copy platen to the lower reach of said electrophotographic belt, said development station being located seated upon said partition within the upper portion of said basket-like support member, said development station including a toner cartridge in close proximity of said one end of the lower reach of said electrophotographic belt and said charging station being disposed adjacent the opposite end of the lower reach of said electrophotographic belt and said charging station being disposed adjacent the opposite end of the lower reach of said electrophotographic belt proximate the commencement of said lower reach.

24. The copy machine as claimed in claim 23 and seating means on said partition to receive said cartridge in proximity to the lower reach of said electrophotographic belt, said cartridge including an elongate open portion along the length thereof and a roller applicator disposed within said cartridge and a conductive surface facing said photoconductive surface of said belt.

25. The copying machine as claimed in claim 24 in which one of said rollers is proximate said toner cartridge and has a greater diameter than the other of said rollers, the outer circumference of said one roller being in close proximity to said toner cartridge and defines a toning gap.

26. The copying machine as claimed in claim 25 in which there are means to generate an electrical bias across said toning gap.

27. A low-profile electrophotographic copying machine comprising:

an electrophotographic imaging belt, a charging station; an exposure station; a development station; a carrier medium supply and feed station; a folded optical projection station having a pair of spaced mirrors for directing a light image from a document to said electrophotographic belt; a transfer station for applying the developed image to a carrier medium received from said supply and feed station; spaced roller means for mounting said electrophotographic belt forming a generally elongate oval having a pair of closely proximate, horizontally oriented generally parallel upper and lower belt reaches; said exposure station being located between ends of the lower reach of said belt; said development station disposed nested between said spaced mirrors and at least partially within said optical projection system; a copy platen for holding said document oriented to face said optical projection system with the upper reach of said electrophotographic belt being spaced laterally from said copy platen and at about the same level as said copy platen; drive means for rotating said spaced roller means through said stations along said reaches, said supply and feed station being disposed immediately above said upper reach of said electrophotographic imaging belt and spaced roller means likewise disposed at about the level of said copy platen; and a housing for containing said electrophotographic belt and spaced roller means, said folded optical projection station, said developing station mounted partially nested within said folded optical projection station and said electrophotographic belt and spaced roller means, located in close proximity to and between said developing station and said supply and feed station; said optical projection system having a rigid support member of basket-like configuration having a pair of oppositely outwardly inclined end walls, a floor and connecting walls and an upstanding partition integral with said floor and disposed between said end walls, a pair of planar mirrors disposed in facing relationship upon respective ones of said end walls and a lens arrangement secured to said partition whereby to project said document image from said copy platen to the downwardly facing lower belt reach at the exposure station.

28. The copying machine as claimed in claim 27 in which said drive means include a drive roller and a follower roller, the drive roller being of larger diameter than the follower roller and disposed nested within said development station as a part thereof.

29. The copying machine as claimed in claim 28 in which said toner station includes a liquid toner containing cartridge formed of electrically insulating material and including a top wall and a longitudinally directed arcuate recessed formation formed on said top wall, an elongate slot formed at the base of said recessed formation, and a conductive surface surrounding said slot along its length, said larger roller being disposed sufficiently within said recessed formation to define a gap between the belt driven thereby and said recessed formation, means to place an electrical bias voltage across said gap, said liquid toner being directed to said gap due to capillarity therebetween and the toner particles of said liquid toner being impelled toward said belt by said electrical bias.

30. The copying machine as claimed in claim 27 in which there are means to establish an electrical bias to effect transfer of said developed image from said belt to said carrier medium when said carrier medium is directed therepast.

31. The copying machine as claimed in claim 27 in which said transfer station includes a transfer roller proximate said belt at the upper reach thereof to define a second gap located therebetween and means to establish an electrical bias across said second gap during passage of said carrier medium therethrough.

* * * * *